US009575424B2

(12) United States Patent
Nakagawa et al.

(10) Patent No.: US 9,575,424 B2
(45) Date of Patent: Feb. 21, 2017

(54) METHOD OF PRODUCING A TONER PARTICLE

(71) Applicant: CANON KABUSHIKI KAISHA, Tokyo (JP)

(72) Inventors: Yoshihiro Nakagawa, Numazu (JP); Masatake Tanaka, Yokohama (JP); Naoya Isono, Suntou-gun (JP); Tsutomu Shimano, Mishima (JP); Shintaro Noji, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 35 days.

(21) Appl. No.: 14/639,412

(22) Filed: Mar. 5, 2015

(65) Prior Publication Data

US 2015/0261110 A1 Sep. 17, 2015

(30) Foreign Application Priority Data

Mar. 12, 2014 (JP) ..... 2014-049373

(51) Int. Cl.
*G03G 9/08* (2006.01)
*G03G 9/087* (2006.01)

(52) U.S. Cl.
CPC ..... *G03G 9/0804* (2013.01); *G03G 9/0821* (2013.01); *G03G 9/08724* (2013.01);
(Continued)

(58) Field of Classification Search
CPC ..... G03G 9/0804; G03G 9/08788
(Continued)

(56) References Cited

U.S. PATENT DOCUMENTS 4,713,310 A * 12/1987 Horie ..... C08J 3/226
430/109.3
5,536,613 A * 7/1996 Chang ..... B29C 47/0011
264/210.1

(Continued)

FOREIGN PATENT DOCUMENTS

| | | | |
|---|---|---|---|
| JP | 2006-65015 | A | 3/2006 |
| JP | 2009-128652 | A | 6/2009 |
| JP | 2012-93704 | A | 5/2012 |

OTHER PUBLICATIONS

Diamond, Arthur S (editor) Handbook of Imaging Materials. New York: Marcel-Dekker, Inc. (2002) pp. 178-182.*

*Primary Examiner* — Christopher Rodee
(74) *Attorney, Agent, or Firm* — Fitzpatrick, Cella, Harper & Scinto

(57) ABSTRACT

A toner particle production method has an annealing step that is performed after the preparation of a resin solution by the dissolution or dispersion, in an organic solvent, of a binder resin having a polyester resin as its major component and a block polymer having a polyester segment and a vinyl polymer segment, and the preparation of a resin particle dispersion in which resin particles are dispersed by a dissolution suspension method, wherein, in this annealing step, the temperature of the obtained resin particle dispersion is held for at least 60 minutes in the temperature range from TgA-15 (° C.) to TmA (° C.), and under the conditions of a temperature variation range of not more than 20° C. and a temperature variation rate of not more than 0.35° C./minute.

6 Claims, 2 Drawing Sheets

(52) U.S. Cl.
CPC ..... *G03G 9/08755* (2013.01); *G03G 9/08788* (2013.01); *G03G 9/08795* (2013.01); *G03G 9/08797* (2013.01)

(58) Field of Classification Search
USPC ..... 430/109.4, 108.4
See application file for complete search history.

(56) References Cited

U.S. PATENT DOCUMENTS

| | | | | |
|---|---|---|---|---|
| 6,569,589 | B2 | 5/2003 | Inaba et al. | |
| 8,440,382 | B2 | 5/2013 | Isono et al. | |
| 9,158,216 | B2 * | 10/2015 | Shimano | G03G 9/0806 |
| 2011/0117486 | A1 * | 5/2011 | Bayley | G03G 9/0804<br>430/108.24 |
| 2011/0200929 | A1 * | 8/2011 | Karato | G03G 9/0804<br>430/108.8 |
| 2013/0171557 | A1 | 7/2013 | Watanabe et al. | |
| 2014/0302437 | A1 | 10/2014 | Shimano et al. | |
| 2014/0349232 | A1 | 11/2014 | Kinumatsu et al. | |

* cited by examiner

METHOD OF PRODUCING A TONER PARTICLE

BACKGROUND OF THE INVENTION

Field of the Invention

The present invention relates to a method of producing a toner particle that is used to form a toner image by the development of an electrostatic latent image that is formed by a method such as an electrophotographic method, electrostatic recording method, or toner jet recording method.

Description of the Related Art

Energy conservation has in recent years been regarded as a major technical issue for copiers, printers, and facsimile machines, and major reductions in the amount of heat applied at a fixing apparatus are desired. Thus, with regard to toners, there is strong need for the ability to undergo fixing at lower energies, or what is known as "low-temperature fixability".

In addition, with the growing global demand for these devices, devices are required that can consistently deliver high-quality images in diverse use environments, in particular, in environments with different temperature and humidity levels. Moreover, a high durability with no decline in image quality is also required for the production of a large number of copies or prints in severe environments.

A general method for improving the low-temperature fixability of toners is to lower the glass transition temperature (Tg) of the binder resin used. However, the heat-resistant storage stability of the toner ends up being impaired when the Tg of the binder resin is just simply lowered, and it is thus quite difficult for the low-temperature fixability to co-exist in good balance with the heat-resistant storage stability.

In pursuit of having the low-temperature fixability of a toner co-exist in good balance with its heat-resistant storage stability, methods have been investigated in which a crystalline resin having an excellent sharp melt property is used for the binder resin. Crystalline polyester resins have a structure in which the polymer chains are regularly arranged and exhibit a behavior whereby they are resistant to softening in the temperature region below the melting point while undergoing sharp melting at the borderline with the melting point with a loss of viscosity. As a result of these characteristics, attention has been given in particular to crystalline polyester resins in recent years and investigations in which they are used as a toner material are being actively carried out.

However, when just the simple addition of a crystalline resin is carried out, not only can the heat-resistant storage stability of the toner deteriorate, but the crystallinity of the crystalline resin may be changed by the toner production conditions and by storage of the toner at high temperatures and the properties of the toner may then deteriorate in association with this. As a consequence, variously engineered toners have been introduced in order to exploit the properties of crystalline resins. Specifically, efforts have been made to improve the heat-resistant storage stability and suppress the changes in the degree of crystallinity induced by residence at high temperatures, by bringing about crystal growth in the crystalline resin by holding the crystalline resin for an extended period of time at a temperature below the melting point of the crystalline resin.

Japanese Patent Application Laid-open No. 2006-65015 introduces a toner production method that includes a step of storing a crystalline resin-containing toner at temperatures from 45° C. to 65° C. However, some of the toner may undergo aggregation in this toner production method due to the storage step at these temperatures. In addition, by carrying out this step as a dry method, a phenomenon is produced in which the crystalline resin present near the toner surface moves to the toner surface in association with crystal growth, and the image density and other development properties of the toner may then undergo a decline.

Japanese Patent Application Laid-open No. 2009-128652 introduces a method in which a heat treatment is performed, on a toner provided by the addition of a crystalline polyester to an amorphous polyester, at a particular temperature below the melting point of the crystalline polyester. Due to the use in the binder resin in this toner of an amorphous polyester, the crystalline polyester is compatible with the binder resin during the toner production process. Due to this, not only does the efficiency in enhancing the degree of crystallinity in the ensuing heat treatment undergo a major decline, but some of the components end up remaining compatible and a satisfactory heat-resistant storage stability may then not be obtained.

The toner production method provided by Japanese Patent Application Laid-open No. 2012-93704 includes a step of holding a toner containing a crystalline polyester resin in an amorphous polyester resin as the binder resin, at a temperature below the melting point of the crystalline resin during production by the dissolution suspension method. However, with this toner again, since the crystalline resin and binder resin are very readily blended compatibly, a satisfactory enhancement of the degree of crystallinity of the crystalline resin in the toner cannot be obtained and the low-temperature fixability cannot be made to co-exist in good balance with the heat-resistant storage stability.

Thus, as seen in the preceding, there have been a variety of efforts with regard to crystalline resin-containing toners to fully utilize the fixing performance due to the addition of the crystalline resin while suppressing the ill effects on the storability; however, a toner production method that efficiently provides favorable properties has yet to be introduced.

SUMMARY OF THE INVENTION

The present invention provides a toner particle production method that solves the existing problems described above. Thus, an object of the present invention is to provide a method of producing a toner that has a satisfactory low-temperature fixability and a satisfactory heat-resistant storage stability and that exhibits little change in properties due to storage at high temperatures.

The production method of the present invention is a method of producing a toner particle, comprising: a step of preparing a resin solution by dissolving, in an organic solvent, a binder resin having a polyester resin as its major component, and a block polymer having a polyester segment and a vinyl polymer segment; a step of preparing a resin solution dispersion by dispersing the resin solution in an aqueous medium; and a step of removing the organic solvent present in the resin solution dispersion to produce a resin particle dispersion in which a pre-annealing-treatment resin particle is dispersed in the aqueous medium, wherein the method of producing a toner particle additionally has a step of holding the resin particle dispersion for at least 60 minutes under temperature conditions that satisfy the following (i), (ii), and (iii):

(i) from TgA-15 (° C.) to TmA (° C.);

(ii) a temperature variation range of not more than 20° C.; and (iii) a temperature variation rate of not more than 0.35° C./minute, where TgA (° C.) indicates a glass transition point of the pre-annealing-treatment resin particle and TmA (° C.) indicates an onset temperature of an endothermic peak originating from the block polymer present in the pre-annealing-treatment resin particle.

The present invention can provide a method of producing a toner that has a satisfactory low-temperature fixability and a satisfactory heat-resistant storage stability and that exhibits little change in properties due to storage at high temperatures.

Further features of the present invention will become apparent from the following description of exemplary embodiments (with reference to the attached drawings).

DESCRIPTION OF THE EMBODIMENTS

In order to improve the degree of crystallinity of the crystalline resin, the present inventors carried out intensive and extensive investigations—in which the molecular design of the crystalline resin and the binder resin was reexamined—into the step of holding the resin particle at prescribed temperature conditions (also referred to hereafter as the annealing step). It was discovered as a result that specific phenomena are observed and the effects due to the annealing step are substantially improved with the use of a binder resin in which the major component is a polyester resin and the use, as the crystalline resin, of a block polymer having a vinyl polymer segment and a polyester segment.

Figure 1:
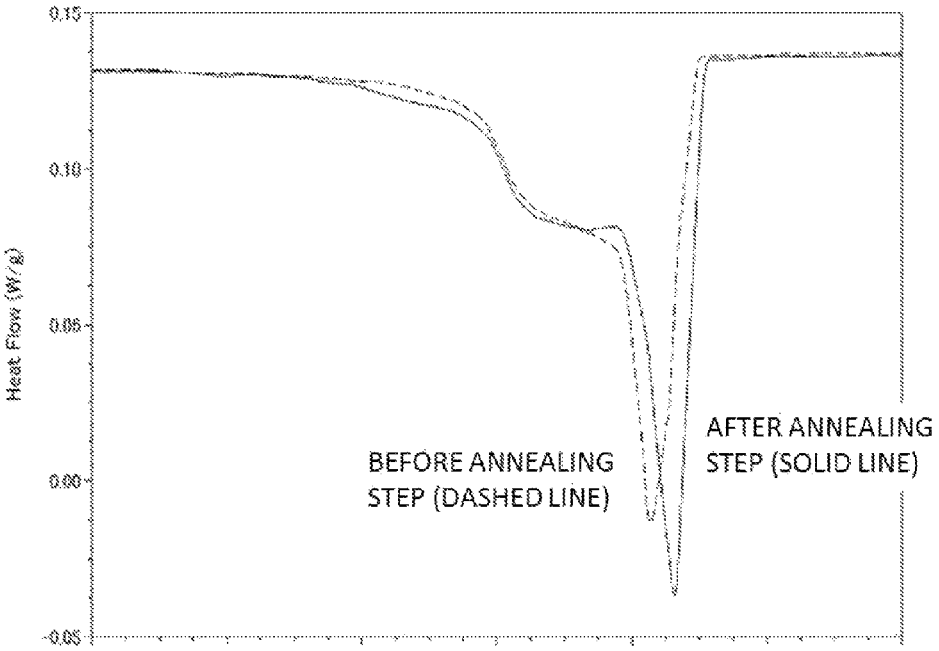
FIG. 1 is a diagram that shows the change in the endothermic characteristics between before and after an annealing treatment, for a conventional example.
Figure 2:
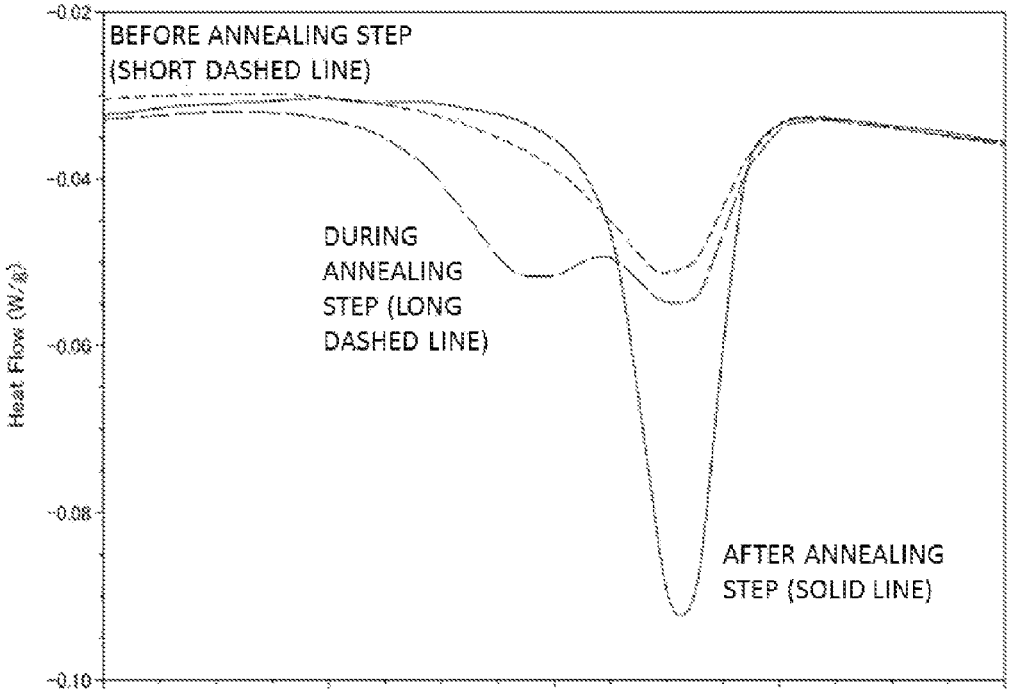
FIG. 2 is a diagram that shows the change in the endothermic characteristics between before and after an annealing treatment, for the present invention.

The changes in the endothermic characteristics between before and after an annealing step are shown in FIG. 1 for the use of a polyester-type binder resin and a crystalline polyester serving as a conventional combination. It is shown here that the endothermic quantity for the endothermic peak originating purely from the crystalline polyester is somewhat increased and the degree of crystallinity of the crystalline resin has thus been increased. FIG. 2, on the other hand, shows the change in the endothermic characteristics between before and after an annealing step for the use of the binder resin and crystalline resin in accordance with the present invention. A new endothermic peak appears at a temperature different from that for the endothermic peak originating from the crystalline resin and exhibits a behavior in which, as the annealing step is continued, it fuses with the original endothermic peak for the crystalline resin; the change in the endothermic quantity is also very large. Based on this, it is thought that, in the case of the use of the binder resin and crystalline resin in accordance with the present invention, the effects due to the annealing step are substantially enhanced through phenomena different from heretofore.

While the cause of these phenomena is unclear, they are believed to be attributable to the state in which the crystalline resin is present in the toner. When a crystalline polyester is added to a polyester-type binder resin, it is thought that the crystalline polyester then resides in an almost entirely compatible state in the toner. This is also supported by the fact that the glass transition temperature of the toner is substantially lower than the glass transition temperature of the original binder resin. When an annealing step is carried out from this state, it is thought that crystal growth requires an extended period of time since it proceeds after the crystalline resin has moved from the compatible state to a state in which domains are formed to a certain degree.

When, on the other hand, the binder resin and crystalline resin in accordance with the present invention are used, a state is observed in which the crystalline resin is microdispersed in the binder resin. It is hypothesized here that, due to the introduction of the vinyl polymer segment into the crystalline polyester, the compatibility with the polyester-type binder resin is reduced and microdispersed domains of the crystalline resin are formed as a result. It is thought that when the annealing step is carried out from this state, crystal nuclei are rapidly produced within the microdispersed domains that have been formed and that the endothermic peak at the temperature different from that for the original crystalline resin is produced due to this nucleus formation process. By continuing the annealing step, the crystal nuclei grow and as a consequence the endothermic peak moves up to a temperature equal to that for the original crystalline resin. It is thought that the efficiency of crystal growth is very substantially enhanced in this step by the formation of crystal nuclei and that as a result this leads to the substantial increase in the endothermic quantity as indicated above. As noted above, the present inventors discovered characteristic phenomena in the annealing step for a toner particle that uses a block polymer having a vinyl polymer segment and a polyester segment and a binder resin in which a polyester resin is the major component, and thereby achieved the present invention.

The general definition of a block polymer is a polymer structured of a plurality of linearly connected blocks (The Society of Polymer Science, Japan; Glossary of Basic Terms in Polymer Science by the Commission on Macromolecular Nomenclature of the International Union of Pure and Applied Chemistry), and the present invention also operates according to this definition.

Herein, "having a polyester resin as its major component" is defined to mean that at least 50 mass % of the binder resin is a polyester resin. In the present invention, the binder resin is preferably entirely a polyester resin, but may also contain, within a range in which the effects of the present invention are not impaired, a binder resin heretofore known for use in toners.

In addition, known vinyl monomers, such as styrene, methyl methacrylate, and n-butyl acrylate, may be used for the composition of the vinyl polymer segment of the block polymer. Viewed in terms of the formation of a phase-separated structure and the compatibility with the binder resin in which the major component is a polyester resin, a more preferred state is obtained in particular when styrene is used as the major component.

The previously indicated styrene and so forth is preferably the major component of the vinyl polymer segment. Vinyl monomers other than styrene may also be used as an auxiliary component. The vinyl monomer usable as this auxiliary component, while not being particularly limited, can be exemplified by α-methylstyrene, α-ethylstyrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, ethylene, propylene, butylene, isobutylene, vinyl chloride, vinylidene chloride, vinyl methyl ether, vinyl ethyl ether, vinyl isobutyl ether, vinyl methyl ketone, vinyl hexyl ketone, methyl isopropenyl ketone, vinylnaphthalene, acrylonitrile, methacrylonitrile, and acrylamide.

The present invention is achieved by subjecting the resin particle dispersion, this being the state in which the resin particles are dispersed in the aqueous medium after the production of the resin particles by a dissolution suspension method, to holding for at least 60 minutes under the conditions of a temperature variation range of not more than 20° C. and a temperature variation rate of not more than 0.35° C./minute, in the temperature range from TgA-15 (° C.) (TgA is the glass transition point of these dispersed particles (the resin particles prior to the annealing treatment)) to TmA (° C.), which is an onset temperature of the endothermic peak originating from the block polymer in these resin particles (the resin particles prior to the annealing treatment).

Here, the determination as to whether resin particle production has finished is made on the basis of the percentage (mass %) of solvent removal from the resin particles in the step of producing the resin particle dispersion by removing the organic solvent. For the present invention, resin particle production is considered to be complete at the point at which a solvent removal percentage (mass %) of at least 99.0% is achieved, and the annealing step is then run using these resin particles.

A state in which the block polymer is microdispersed in the binder resin can be formed by producing the resin particles by a dissolution suspension method. The effects of the present invention as described above are then obtained as a result. The amount of addition of the block polymer, expressed per 100 mass parts of the binder resin, is preferably from 5.0 mass parts to 50.0 mass parts and is more preferably from 10.0 mass parts to 40.0 mass parts.

By having the annealing temperature be from TgA-15 (° C.) to TmA (° C.), the ability of the binder resin to restrain or constrict the molecular motion of the block polymer is suppressed and the block polymer undergoes recrystallization, and the effects due to the annealing step are then obtained as a consequence.

The annealing step in the present invention is more preferably carried out at a temperature from at least TgA (the glass transition temperature of the resin particle)—15 (° C.) to not more than TcA (° C.), which is a temperature at the finish of the heat generation that accompanies crystallization of the block polymer present in the dispersion particle prior to this annealing treatment. By using not more than TcA (° C.), the crystal growth rate of the block polymer can be further sped up and a satisfactory crystallization can be carried out even for low-melting components, e.g., low molecular weight components, and as a consequence the effects due to the annealing can be enhanced still further. Due to this an even better heat resistance and developing performance can be obtained.

This TgA (° C.), TmA (° C.), and TcA (° C.) can be controlled through the species of monomer constituting the individual resins and through the molecular weight. The methods for measuring TgA (° C.), TmA (° C.), and TcA (° C.) are described below.

While the temperature desirably does not change during the annealing step, a temperature variation rate in this step of not more than 0.35° C./minute is unproblematic from the standpoint of realizing the effects of the annealing step. The temperature variation rate is more preferably not more than 0.20° C./minute. Here, the temperature variation rate is represented by the maximum value of the values obtained by dividing the amount (° C.) of the temperature variation by the resin particle dispersion in the annealing step by the time (minutes) required for this temperature variation. When temperature variations are produced a plurality of times in the annealing step, for the present invention the temperature variation rate calculated for each of these temperature variations should satisfy the indicated range. The calculation of the temperature variation rate is carried out based on a temperature variation over a time interval of at least 1 minute.

By having the temperature variation rate in the annealing step be not more than 0.35° C./minute, the crystal nuclei of the block polymer can then be efficiently formed and crystal growth can be carried out efficiently while maintaining the block polymer domains in a microdispersed state.

In addition, formation of the crystal nuclei of the block polymer and crystal growth can both be carried out at a satisfactory rate by having the temperature variation range, which is the difference between the highest temperature and the lowest temperature of the resin particle dispersion, in the annealing step be not more than 20° C. and preferably not more than 15° C., and due to this the block polymer can be brought into a microdisperse state that also has a high degree of crystallinity. When temperature variations are produced a plurality of times during the annealing step, the temperature variation range for each temperature variation should satisfy the indicated range.

An improvement in the heat resistance accompanying crystallization of the block polymer is obtained by having the time for the annealing step be at least 60 minutes. The upper limit on the time for the annealing step is not specifically prescribed, and, since significant changes in the effects are not produced even by holding for 1200 minutes or more, it may be determined considering the balance with the production efficiency. In addition, the annealing step may also be carried out divided into a plurality of times, in which case the total time for the annealing step time should be in the indicated range. The total holding time is preferably from 120 minutes to 480 minutes.

By exercising the control that has been described in the preceding, a toner can be produced for which an excellent low-temperature fixability can co-exist with an excellent heat resistance and which evidences little change in fixing performance and developing performance even after storage at high temperatures. In addition, the temperature variation range is the difference between the highest temperature and the lowest temperature of the resin particle dispersion in the annealing step.

Viewed in terms of the annealing efficiency and the co-existence of the low-temperature fixability in good balance with the heat resistance, the polyester segment of the block polymer preferably has a unit expressed by the following formula (1) and a unit expressed by the following formula (2):

[C1]

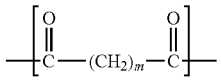

(1)

(m in formula (1) represents an integer from 6 to 14)

[C2]

$$-\!\!\left[O-(CH_2)_n-O\right]\!\!- \quad (2)$$

(n in formula (2) represents an integer from 6 to 16).

The polyester segment of the block polymer can be produced from, for example, a dicarboxylic acid with formula (A) below, or its alkyl ester or anhydride, and a diol with formula (B) below $$HOOC-(CH_2)_m-COOH \quad \text{formula (A)}$$

(m in the formula represents an integer from 6 to 14)

$$HO-(CH_2)_n-OH \quad \text{formula (B)}$$

(n in the formula represents an integer from 6 to 16).

For the dicarboxylic acid, and insofar as the same skeletal substructure is formed in the polyester segment, a compound may be used in which the carboxyl group has been converted into the alkyl ester (preferably $C_{1-4}$) or into the anhydride.

By having m and n in the formulas be in the indicated ranges, the dispersion of the block polymer in the toner particle can be made even more microdisperse and the crystal growth rate during annealing can be sped up further. This makes it possible to obtain an even better low-temperature fixability while maintaining the heat resistance. A more preferred range for m is from 7 to 10 and a more preferred range for n is from 6 to 12. In addition, m and n preferably satisfy the relationship $14 \leq m+n \leq 22$ and more preferably $14 \leq m+n \leq 20$. When m+n is larger than 22, it then becomes increasingly difficult to obtain an excellent fixing performance. When m+n is less than 14, it then becomes increasingly difficult to obtain an excellent heat-resistant storage stability and an excellent developing performance.

The value of the solubility parameter (SP) of this polyester segment is more preferably from 9.40 to 10.00. By satisfying the indicated range, a high compatibility between the binder resin and block polymer is obtained during melting and an even larger effect supporting the low-temperature fixability is obtained.

The glass transition point TgB (° C.) of the vinyl polymer segment of the block polymer is preferably equal to or greater than TmA (° C.). By having TgB (° C.) be equal to or greater than TmA (° C.), the annealing step is then run at or below the glass transition point TgB (° C.) of the vinyl polymer segment. By doing this, the migration and relocation of the block polymer domains microdispersed in the resin particle can be suppressed and an improvement in the degree of crystallinity can be achieved while keeping a favorable microdispersed state. As a result, an even better heat-resistant storage stability can be obtained while maintaining the low-temperature fixability.

The TgB (° C.) of the vinyl polymer segment can be controlled through the species of the monomer that produces the vinyl polymer segment and through the molecular weight of the vinyl polymer segment.

The mass ratio (C/A) between the polyester segment (C) and the vinyl polymer segment (A) in the block polymer is preferably 40/60 to 70/30 and is more preferably 50/50 to 70/30. By using this range, the melting properties as of a crystalline resin can also be made to co-exist while the dispersion state of the block polymer in the resin particle is made microdisperse. As a result, the effects of the annealing step can be obtained more efficiently while also maintaining an even better low-temperature fixability. The mass ratio between the polyester segment and the vinyl polymer segment in the block polymer can be controlled through, for example, the production conditions, such as the temperature and synthesis time during production of the block polymer, and through the monomer charge proportions. The method for analyzing the mass ratio between the polyester segment and the vinyl polymer segment in the block polymer is described below.

The peak temperature Tmp (° C.) for the melting point of the block polymer is preferably from 55° C. to 100° C. By using this range, a reduction in the heat resistance can be suppressed while the low-temperature fixability due to the addition of the block polymer is exhibited. Tmp (° C.) is more preferably from 60° C. to 90° C. This Tmp (° C.) can be controlled through the molecular weight and through the monomer species used to produce the polyester segment of the block polymer. The method for measuring Tmp (° C.) is described below.

The weight-average molecular weight (Mw) of the block polymer is preferably from 20,000 to 45,000. By using at least 20,000, the block polymer compatibly blended in the binder resin is more rapidly recrystallized in the annealing step. By using not more than 45,000, the melt viscosity of the block polymer can be made appropriate for the low-temperature fixability. The weight-average molecular weight (Mw) of the block polymer is more preferably from 23,000 to 40,000. The weight-average molecular weight (Mw) of the block polymer can be controlled through the synthesis temperature and the synthesis time during production of the block polymer. The weight-average molecular weight (Mw) of the block polymer is measured by the method described below.

The toner particle of the present invention is obtained by subjecting the resin particles to the annealing treatment in an aqueous medium after the resin particles have been produced using a dissolution suspension method.

A specific method for producing the resin particles using a dissolution suspension method is described in the following, but there is no limitation to this.

A resin solution is prepared by adding the binder resin and block polymer to an organic solvent. A disperser such as a homogenizer, ball mill, colloid mill, or ultrasonic disperser may be used with the goal of enhancing the dispersity of the colorant. Moreover, a dispersion may be preliminarily prepared by dispersing a pigment in an organic solvent using such a disperser and this dispersion may be used. As necessary, for example, a colorant, release agent, polar resin, pigment dispersing agent, and charge control agent may be added as appropriate to this resin solution.

This resin solution is then introduced into a preliminarily prepared aqueous medium that contains a dispersion stabilizer and suspension and granulation are carried out using a high-speed disperser, such as a high-speed stirrer or an ultrasonic disperser, to obtain a resin solution dispersion.

A resin particle dispersion is subsequently obtained by raising the temperature of the whole system and evaporatively removing the organic solvent in the resin solution and thereby providing resin particles by the precipitation of the resin in the solution.

The obtained resin particle dispersion is subjected to an annealing treatment according to the hereinabove-described conditions. This annealing treatment may be carried out using a cooling process when the resin particle dispersion resides at a high temperature, or it may be carried out by reheating after the aqueous dispersion of the resin particles has been cooled. A dispersing agent, such as a surfactant or inorganic fine particles, may also be added at this point with the goal of preventing particle aggregation and coalescence. The toner particle can thereafter be obtained by washing as necessary and drying and classification by the usual methods.

The materials that can be used in the toner particle production method according to the present invention are exemplified and specifically described in the following, but there is no limitation to or by the following.

A polyester provided by the condensation polymerization of an alcohol monomer and a carboxylic acid monomer is used as the polyester that is used as the major component of the binder resin in the toner of the present invention. The alcohol monomer can be exemplified by the following:

the alkylene oxide adducts of bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid, and their anhydrides; alkyl dicarboxylic acids such as succinic acid, adipic acid, sebacic acid, and azelaic acid, and their anhydrides; succinic acid substituted by a $C_{6-18}$ alkyl group or alkenyl group, and anhydrides thereof; and unsaturated dicarboxylic acids such as fumaric acid, maleic acid, and citraconic acid, and their anhydrides.

The following monomers may also be used in addition to the preceding:

polyhydric alcohols such as glycerol, sorbitol, sorbitan, and, for example, the oxyalkylene ethers of novolac-type phenolic resins; also, polybasic carboxylic acids such as trimellitic acid, pyromellitic acid, benzophenonetetracarboxylic acid, and their anhydrides.

In particular, resins in which the following polyester unit components are condensation polymerized are preferred because such resins have excellent charging characteristics: the bisphenol derivative represented by general formula (3) below for the dihydric alcohol monomer component; a carboxylic acid component composed of an at least dibasic carboxylic acid or its anhydride or lower alkyl ester (for example, fumaric acid, maleic acid, maleic anhydride, phthalic acid, terephthalic acid, trimellitic acid, and pyromellitic acid) for the acid monomer component.

[C3]

(3)

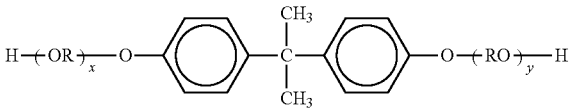

(In the formula, R represents the ethylene group or propylene group; x and y are each integers equal to or greater than 1; and the average value of x+y is 2 to 10.)

The toner according to the present invention may contain a colorant. Known colorants, such as the various heretofore known dyes and pigments, can be used as this colorant.

The following may be used as the black colorant: carbon black, magnetic bodies, and black colorants provided by color mixing to give a black color using the yellow/magenta/cyan colorants given below. For example, the colorants given below may be used as colorants for cyan toners, magenta toners, and yellow toners.

Compounds as typified by monoazo compounds, disazo compounds, condensed azo compounds, isoindolinone compounds, anthraquinone compounds, azo metal complex methine compounds, and allylamide compounds may be used as pigment-based yellow colorants. Specific examples are C. I. Pigment Yellow 74, 93, 95, 109, 111, 128, 155, 174, 180, and 185.

Monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds may be used as magenta colorants. Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C. I. Pigment Violet 19.

Copper phthalocyanine compounds and derivatives thereof, anthraquinone compounds, and basic dye lake compounds can be used as cyan colorants. Specific examples are C. I. Pigment Blue 1, 7, 15, 15:1, 15:2, 15:3, 15:4, 60, 62, and 66.

A magnetic body may be present in the toner particle when the toner of the present invention is used as a magnetic toner. In this case the magnetic body may also function as a colorant. This magnetic body can be exemplified in the present invention by iron oxides such as magnetite, hematite, and ferrite, and by metals such as iron, cobalt, and nickel. It may also be exemplified by alloys of these metals with metals such aluminum, cobalt, copper, lead, magnesium, tin, zinc, antimony, beryllium, bismuth, cadmium, calcium, manganese, selenium, titanium, tungsten, and vanadium, and by their mixtures.

A known release agent can be used without particular limitation as the release agent that may be used in the present invention. The following compounds are examples: aliphatic hydrocarbon waxes such as low molecular weight polyethylene, low molecular weight polypropylene, microcrystalline wax, paraffin wax, and Fischer-Tropsch wax; the oxides of aliphatic hydrocarbon waxes, such as oxidized polyethylene wax, and their block copolymers; waxes in which the major component is a fatty acid ester, such as carnauba wax, sasol wax, ester wax, and montanic acid ester wax; the products of the partial or complete deacidification of fatty acid esters, such as deacidified carnauba wax; waxes provided by grafting, using a vinylic monomer such as styrene or acrylic acid, onto an aliphatic hydrocarbon wax; the partial esters of polyhydric alcohols and fatty acids, such as behenyl monoglyceride; and the hydroxyl group-containing methyl ester compounds obtained by, for example, the hydrogenation of vegetable fats and oils.

The toner particle of the present invention may also use a charge control agent. The use is preferred thereamong of a charge control agent that controls the toner particle to a negative chargeability. Such a charge control agent can be exemplified by the following:

organometal compounds, chelate compounds, monoazo metal compounds, acetylacetone metal compounds, urea derivatives, metal-containing salicylic acid-type compounds, metal-containing naphthoic acid-type compounds, quaternary ammonium salts, calixarene, silicon compounds, and metal-free carboxylic acid compounds and their derivatives. Sulfonic acid resins having a sulfonic acid group, sulfonate salt group, or sulfonate ester group may also be favorably used.

A known surfactant or organic dispersing agent or inorganic dispersing agent can be used as the dispersion stabilizer that is added to the aqueous medium. Among the preceding, inorganic dispersing agents can be favorably used because they suppress stability disruptions even due to the polymerization temperature or the passage of time and because they are also easily washed out and tend to avoid exercising negative effects on the toner. The inorganic dispersing agents can be exemplified by the following: multivalent metal salts of phosphoric acid, such as tricalcium phosphate, magnesium phosphate, aluminum phosphate, and zinc phosphate; carbonate salts such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina. After the completion of the polymerization, these inorganic dispersing agents can be almost completely removed by dissolution through the addition of acid or alkali.

The methods for measuring the various property values specified in the present invention are described in the following.

<Methods for Measuring TgA, TmA, TcA, Tmp, TgB, and the Glass Transition Point of the Toner Particle>

TgA, TmA, TcA, Tmp, and TgB are measured based on ASTM D 3418-82 using a "Q1000" (TA Instruments) differential scanning calorimeter. The melting points of indium and zinc are used for temperature correction in the instrument detection section, and the heat of fusion of indium is used for correction of the amount of heat.

Specifically, 2 mg of the measurement sample is accurately weighed out and is introduced into the aluminum pan. Using an empty aluminum pan as the reference, a modulation measurement is run using the following settings: ramp rate=1° C./minute in the measurement range from 0° C. to 120° C., oscillation temperature amplitude ±0.318° C./minute. During this ramp process, changes are obtained in the specific heat in the temperature range from 0° C. to 120° C.

The glass transition point TgA (° C.) of the resin particle and the glass transition point of the toner particle are taken to be the temperature at the intersection between the curve segment for the stepwise change at the glass transition and the straight line that is equidistant, in the direction of the vertical axis, from the straight lines formed by extending the baselines for prior to and subsequent to the appearance of the change in the specific heat in the curve for the reversible specific heat change.

TmA (° C.), i.e., the onset temperature for the endothermic peak originating from the block polymer in the resin particle, is taken to be the intersection between the straight line provided by extending the base line on the low temperature side to the high temperature side, and the tangent line drawn to the curve on the low temperature side of the melting peak at the point where its slope is at a maximum. The temperature at the apex of this endothermic peak is taken to be Tmp (° C.), and the endothermic quantity originating from the block polymer is taken to be the endothermic quantity (J/g).

Measurement of the glass transition point TgB (° C.) of the vinyl polymer segment of the block polymer is carried out by hydrolyzing the polyester segment of the block polymer. In the specific method, 5 mL of dioxane and 1 mL of a 10 mass % aqueous potassium hydroxide solution are added to 30 mg of the block polymer and the polyester segment is hydrolyzed by shaking for 6 hours at a temperature of 70° C. The solution is then dried and the resulting solid fraction is dispersed and dissolved in ethanol. Filtration and removal of the solubles by washing then provides the vinyl polymer segment. The procedure subsequent to this is carried out as for the measurement of TgA.

TcA (° C.), i.e., the temperature at the finish of the heat generation that accompanies the crystallization of the block polymer, is taken to be—for the exothermic peak when measurement is performed at a rate of temperature decline set to 1° C./minute at the measurement temperatures from 100° C. to 0° C.—the intersection between the straight line provided by extending the base line on the low temperature side to the high temperature side, and the tangent line drawn to the curve on the low temperature side at the point where its slope is at a maximum.

<Method for Measuring the Mass Ratio (C/A Ratio) Between the Polyester Segment and the Vinyl Polymer Segment in the Block Polymer>

The mass ratio between the polyester segment and the vinyl polymer segment in the block polymer was measured using nuclear magnetic resonance spectroscopy ($^1$H-NMR, 400 MHz, $CDCl_3$, room temperature (25° C.)). measurement instrument: JNM-EX400 FT-NMR instrument (JEOL Ltd.)

measurement frequency: 400 MHz pulse condition: 5.0 μs frequency range: 10500 Hz number of integrations: 64

The mass ratio (C/A ratio) between the polyester segment and the vinyl polymer segment was calculated from the integration values in the resulting spectrum.

<Method of Calculating the SP Value>

The SP value (=δi) was calculated in the present invention using equation (1) according to Fedors. Here, for the values of Δei and Δvi refer to "Energies of Vaporization and Molar Volumes (25° C.) of Atoms and Atomic Groups" in Tables 3 to 9 of "Basic Coating Science" (pp. 54-57, 1986 (Maki Shoten Publishing)).

$$\delta i=[Ev/V]^{1/2}=[\Delta ei/\Delta vi]^{1/2} \quad \text{equation (1)}$$

Ev: energy of vaporization

V: molar volume

Δei: energy of vaporization of the atoms or atomic groups of component i

Δvi: molar volume of the atoms or atomic groups of component i

For example, hexanediol is built of (—OH)×2+(—$CH_2$)×6 atomic groups, and its SP value is determined from the following formula.

$$\delta i=[\Delta ei/\Delta vi]^{1/2}=[\{(5220)\times 2+(1180)\times 6\}/\{(13)\times 2+(16.1)\times 6\}]^{1/2}$$

The SP value (δi) then evaluates to 11.95.

<The Method for Measuring the Molecular Weight>

The weight-average molecular weight (Mw) of the block polymer, crystalline polyester and so on is measured as described in the following by gel permeation chromatography (GPC).

First, the measurement sample is dissolved in tetrahydrofuran (THF). The resulting solution is filtered across a "MaeShoriDisk" solvent-resistant membrane filter (Tosoh Corporation) having a pore diameter of 0.2 μm to obtain a sample solution. This sample solution is adjusted to bring the concentration of the THF-soluble component to 0.8 mass %. The measurement is carried out under the following conditions using this sample solution.

instrument: "HLC-8220GPC" high-performance GPC instrument (Tosoh Corporation)
column: 2×LF-604 (Showa Denko Kabushiki Kaisha)
eluent: THF
flow rate: 0.6 mL/minute
oven temperature: 40° C.
sample injection amount: 0.020 mL The molecular weight of the sample is determined using a molecular weight calibration curve constructed using standard polystyrene resins (for example, trade name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Method for Measuring the Weight-Average Particle Diameter (D4) and the Number-Average Particle Diameter (D1)>

The weight-average particle diameter (D4) and the number-average particle diameter (D1) of the toner are determined as follows. The measurement instrument used is a "Coulter Counter Multisizer 3" (registered trademark, from Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flatbottom glass beaker. To this is added as dispersing agent 0.3 mL of a dilution prepared by the three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of ion-exchanged water is introduced into the water tank of this ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4); when set to graph/number % with the dedicated software, the "average diameter" on the "analysis/numerical statistical value (arithmetic average)" screen is the number-average particle diameter (D1).

<Method for Measuring the Percentage Removal of the Solvent in the Resin Particles>

The percentage removal of the solvent in the resin particles is measured as described in the following using gas chromatography (GC).

Approximately 500 mg of the resin particle dispersion is accurately weighed out and introduced into a sample bottle. Approximately 10 g of acetone is accurately weighed out and added to the sample bottle and the cap is applied. This is followed by thorough mixing and exposure for 30 minutes to ultrasound from a benchtop ultrasound cleaner (for example, the "B2510J-MTH" (product name) from Branson Ultrasonics) having an oscillation frequency of 42 kHz and an electrical output of 125 W. Filtration is then carried out across a "MaeShoriDisk" solvent-resistant membrane filter (Tosoh Corporation) having a pore diameter of 0.2 μm, and 2 μL of the filtrate is analyzed by gas chromatography. The residual amount of the remaining solvent is determined from a calibration curve constructed in advance using the solvent that has been used. The solvent removal percentage (mass %) is then determined using the following formula: 100×(1−(residual amount)/(total amount of solvent used)).

EXAMPLES

The present invention is specifically described through the examples provided below, but the present invention is not limited to or by these examples. The number of parts used in the examples indicates mass parts in all instances.

<Production of Crystalline Polyester 1>

100.0 parts of sebacic acid and 106.5 parts of 1,12-dodecanediol were added to a reactor equipped with a stirrer, thermometer, nitrogen introduction line, water separator, and vacuum apparatus and were heated to a temperature of 130° C. while stirring. 0.7 parts of titanium(IV) isopropoxide was added as an esterification catalyst followed by raising the temperature to 160° C. and carrying out a condensation polymerization for 5 hours. The temperature was then raised to 180° C. and a reaction was run while reducing the pressure until the desired molecular weight was reached, thereby yielding crystalline polyester 1. This crystalline polyester 1 had a weight-average molecular weight (Mw) of 19,000 and a melting point (Tm) of 84° C.

<Production of Block Polymer 1>

100.0 parts of crystalline polyester 1 and 440.0 parts of dry chloroform were added to a reactor equipped with a stirrer, thermometer, and nitrogen introduction line; after complete dissolution 5.0 parts of triethylamine was added; and 15.0 parts of 2-bromoisobutyryl bromide was gradually added while cooling with ice. This was followed by stirring for 24 hours at room temperature (25° C.)

The resulting solution was gradually added dropwise to a container filled with 550.0 parts of methanol in order to reprecipitate the resin fraction, followed by filtration, purification, and drying to obtain crystalline polyester 1-2.

100.0 parts of the thusly obtained crystalline polyester 1-2, 100.0 parts of styrene, 3.5 parts of copper(I) bromide, and 8.5 parts of pentamethyldiethylenetriamine were then added to a reactor fitted with a stirrer, thermometer, and nitrogen introduction line and a polymerization reaction was run at a temperature of 110° C. while stirring. The reaction was stopped when the desired molecular weight was reached followed by reprecipitation with 250.0 parts of methanol, filtration, purification, and removal of the unreacted styrene and the catalyst. Drying was then carried out in a vacuum dryer set to 50° C. to obtain a block polymer 1 that had a polyester segment and a vinyl polymer segment.

<Production of Crystalline Polyesters 2 to 5>

Crystalline polyesters 2 to 5 were obtained proceeding as in the method of producing crystalline polyester 1, but instead using the starting materials given in Table 1. The weight-average molecular weight Mw and the SP value of the crystalline polyesters are also given in Table 1.

TABLE 1

| | acid monomer | mass parts | alcohol monomer | mass parts | weight-average molecular weight Mw | SP value |
|---|---|---|---|---|---|---|
| crystalline polyester 1 | sebacic acid | 100.0 | 1,12-dodecanediol | 106.5 | 19000 | 9.48 |
| crystalline polyester 2 | dodecanedioic acid | 100.0 | 1,12-dodecanediol | 93.5 | 19000 | 9.45 |
| crystalline polyester 3 | sebacic acid | 100.0 | 1,6-hexanediol | 62.3 | 20000 | 9.80 |
| crystalline polyester 4 | tetradecanedioic acid | 100.0 | 1,12-dodecanediol | 83.4 | 19000 | 9.35 |
| crystalline polyester 5 | octanedioic acid | 100.0 | 1,6-hexanediol | 72.3 | 19000 | 9.97 |

<Production of Block Polymers 2 to 11>

Block polymers 2 to 11 were obtained proceeding as in the method of producing block polymer 1, but instead using the starting materials given in Table 2.

The properties of the thusly obtained block polymers 1 to 11 and crystalline polyester 1 are given in Table 3.

TABLE 2

| | crystalline polyester segment | | monomer composition of the vinyl polymer segment | |
|---|---|---|---|---|
| | crystalline polyester | mass parts | vinyl monomer | mass parts per 100 parts of the polyester segment |
| block polymer 1 | crystalline polyester 1 | 100.0 | styrene | 100.0 |
| block polymer 2 | crystalline polyester 1 | 100.0 | styrene | 80.0 |
| block polymer 3 | crystalline polyester 1 | 100.0 | styrene | 150.0 |
| block polymer 4 | crystalline polyester 1 | 100.0 | styrene | 80.0 |
| block polymer 5 | crystalline polyester 1 | 100.0 | styrene | 150.0 |
| block polymer 6 | crystalline polyester 1 | 100.0 | styrene:n-BA 90:10 | 100.0 |
| block polymer 7 | crystalline polyester 1 | 100.0 | styrene:n-BA 83:17 | 100.0 |
| block polymer 8 | crystalline polyester 2 | 100.0 | styrene | 100.0 |
| block polymer 9 | crystalline polyester 3 | 100.0 | styrene | 100.0 |
| block polymer 10 | crystalline polyester 4 | 100.0 | styrene | 100.0 |
| block polymer 11 | crystalline polyester 5 | 100.0 | styrene | 100.0 |

The n-BA in the table indicates n-butyl acrylate.

TABLE 3

| | weight-average molecular weight Mw | C/A ratio | glass transition point TgB (° C.) of the vinyl polymer segment |
|---|---|---|---|
| block polymer 1 | 33000 | 60/40 | 95 |
| block polymer 2 | 28000 | 70/30 | 95 |
| block polymer 3 | 37000 | 40/60 | 95 |
| block polymer 4 | 24000 | 72/28 | 95 |
| block polymer 5 | 40000 | 38/62 | 95 |
| block polymer 6 | 27000 | 60/40 | 75 |
| block polymer 7 | 32000 | 60/40 | 60 |
| block polymer 8 | 34000 | 60/40 | 95 |
| block polymer 9 | 33000 | 60/40 | 95 |
| block polymer 10 | 32000 | 60/40 | 95 |
| block polymer 11 | 33000 | 60/40 | 95 |
| crystalline polyester 1 | 19000 | 100/0 | — |

<Production of the Binder Resin>

The following materials were weighed into a reactor fitted with a condenser, stirrer, and nitrogen introduction tube.

| | |
|---|---|
| terephthalic acid | 22.6 mass parts |
| trimellitic anhydride | 1.8 mass parts |
| polyoxypropylene(2.2)-2,2-bis(4-hydroxyphenyl)propane | 75.6 mass parts |
| titanium dihydroxybis(triethanolaminate) | 0.2 mass parts |

This was followed by heating to 200° C. and reacting for 8 hours while introducing nitrogen and removing the evolved water. The pressure was then lowered to 10.0 mmHg and a reaction was run for 1 hour to synthesize a resin 1.

The molecular weights for resin 1 as determined by GPC were a weight-average molecular weight (Mw) of 5,500, a number-average molecular weight (Mn) of 2,500, and a peak molecular weight (Mp) of 3,000, and its glass transition temperature (Tg) was 55° C.

<Production of the Aqueous Medium>

390.0 mass parts of a 0.1 mol/liter aqueous solution of sodium phosphate ($Na_3PO_4$) was introduced into 1152.0 mass parts of ion-exchanged water; after heating to 60° C. while stirring using a CLEARMIX (M Technique Co., Ltd.), 58.0 mass parts of a 1.0 mol/liter aqueous solution of calcium chloride ($CaCl_2$) was added; and stirring was continued to produce an aqueous medium that contained tricalcium phosphate ($Ca_3(PO_4)_2$) as a dispersion stabilizer.

<Production of a Pigment Dispersion>

10 parts of a copper phthalocyanine pigment (Pigment Blue 15:3) and 60 parts of ethyl acetate were introduced into a wet attritor (Nippon Coke & Engineering Co., Ltd.) and a pigment dispersion was obtained by dispersion by 5 hours.

<Production of Resin Particle 1>

| | |
|---|---|
| binder resin | 100.0 parts |
| block polymer 1 | 30.0 parts |
| pigment dispersion | 42.0 parts |
| paraffin wax (HNP-51: Nippon Seiro Co., Ltd., melting point = 74° C.) | 10.0 parts |
| ethyl acetate | 100.0 parts |

A mixture with this composition was introduced into a wet attritor (Nippon Coke & Engineering Co., Ltd.) and was dispersed for 2 hours to obtain a resin solution.

This was introduced into the aqueous medium described above and a granulating step was performed for 10 minutes using a CLEARMIX (M Technique Co. Ltd.) while maintaining 15000 rpm. This was followed by holding for 8.0 hours at 90° C. or above while stirring with a propeller blade at 150 rpm to remove the solvent and thereby obtain a resin particle dispersion 1.

After this, a portion of the resin particle dispersion 1 was sampled out and the temperature was cooled to 20° C. while continuing to stir. Measurement of the solvent removal percentage on this resin particle dispersion 1 gave a value of 100.0 (mass %). The sampled-out dispersion was brought to a pH equal to or less than 1.5 by the addition of hydrochloric acid, followed by washing•drying to provide a resin particle 1. The obtained resin particle 1 had a weight-average particle diameter of 5.5 μm, a TgA (° C.) of 43° C., a TmA (° C.) of 65° C., and a TcA of 52° C.

<Production of Resin Particles 2 to 12>

Resin particles 2 to 12 were obtained proceeding as in the method for producing resin particle 1, but using block polymers 2 to 11 or crystalline polyester 1 in place of block polymer 1.

The properties of the obtained resin particles 1 to 12 are given in Table 4.

TABLE 4

| | | properties of the resin particles | | | | |
|---|---|---|---|---|---|---|
| | block polymer | solvent removal percentage (mass %) | glass transition point, TgA (° C.) | temperature of endothermic peak onset, TmA (° C.) | temperature at finish of heat generation accompanying crystallization, TcA (° C.) | weight-average particle diameter (μm) |
| resin particle 1 | block polymer 1 | 100.0 | 43 | 65 | 52 | 5.5 |
| resin particle 2 | block polymer 2 | 100.0 | 41 | 68 | 55 | 5.3 |
| resin particle 3 | block polymer 3 | 100.0 | 46 | 62 | 53 | 5.4 |
| resin particle 4 | block polymer 4 | 100.0 | 39 | 68 | 55 | 5.5 |
| resin particle 5 | block polymer 5 | 100.0 | 48 | 63 | 52 | 5.6 |
| resin particle 6 | block polymer 6 | 100.0 | 45 | 65 | 52 | 5.3 |
| resin particle 7 | block polymer 7 | 100.0 | 45 | 65 | 52 | 5.2 |
| resin particle 8 | block polymer 8 | 100.0 | 47 | 80 | 69 | 5.6 |
| resin particle 9 | block polymer 9 | 100.0 | 39 | 58 | 41 | 5.4 |
| resin particle 10 | block polymer 10 | 100.0 | 47 | 81 | 70 | 5.3 |
| resin particle 11 | block polymer 11 | 100.0 | 38 | 52 | 39 | 5.7 |
| resin particle 12 | crystalline polyester 1 | 100.0 | 35 | 60 | 60 | 5.2 |

Examples 1 to 17

An annealing treatment was carried out under the conditions shown in Table 5 using the resin particle dispersions 1 to 11, after which the temperature was cooled to 20° C. while continuing to stir. This was followed by hydrochloric acid addition•washing•drying as in the production of resin particle 1 to obtain toner particles 1 to 17.

Example 18

After carrying out the solvent removal step entirely as in the production of resin particle 1, the temperature decline was stopped at 50° C. and an annealing step was carried out by holding the temperature for 300 minutes in this state. The temperature variation range in the annealing step was 2° C. and the maximum temperature variation rate was 0.1° C./minute. After the completion of the annealing step, the temperature was cooled to 20° C. while continuing to stir. Thereafter, toner particle 18 was obtained by hydrochloric acid addition•washing•drying as in the production of resin particle 1.

Comparative Examples 1 to 6

Using resin particle dispersions 1, 8, and 12, an annealing treatment was carried out under the conditions given in Table 5 followed by cooling the temperature to 20° C. while continuing to stir. After this, toner particles 19 to 24 were obtained by hydrochloric acid addition•washing•drying as in the production of resin particle 1.

The properties of the obtained toner particles 1 to 24 are given in Table 6.

TABLE 5

| | | | conditions in the annealing treatment step | | | | |
|---|---|---|---|---|---|---|---|
| | | | highest temperature (° C.) | lowest temperature (° C.) | temperature variation range (° C.) | maximum temperature variation rate (° C./minute) | treatment time (minutes) |
| Example 1 | toner particle 1 | resin particle dispersion 1 | 51 | 49 | 2 | 0.10 | 300 |
| Example 2 | toner particle 2 | resin particle dispersion 2 | 51 | 49 | 2 | 0.10 | 300 |
| Example 3 | toner particle 3 | resin particle dispersion 3 | 51 | 49 | 2 | 0.10 | 300 |
| Example 4 | toner particle 4 | resin particle dispersion 4 | 51 | 49 | 2 | 0.10 | 300 |
| Example 5 | toner particle 5 | resin particle dispersion 5 | 51 | 49 | 2 | 0.10 | 300 |
| Example 6 | toner particle 6 | resin particle dispersion 6 | 51 | 49 | 2 | 0.10 | 300 |
| Example 7 | toner particle 7 | resin particle dispersion 7 | 51 | 49 | 2 | 0.10 | 300 |
| Example 8 | toner particle 8 | resin particle dispersion 8 | 51 | 49 | 2 | 0.10 | 300 |
| Example 9 | toner particle 9 | resin particle dispersion 9 | 41 | 40 | 1 | 0.10 | 300 |
| Example 10 | toner particle 10 | resin particle dispersion 10 | 52 | 50 | 2 | 0.10 | 300 |
| Example 11 | toner particle 11 | resin particle dispersion 11 | 36 | 35 | 1 | 0.10 | 300 |
| Example 12 | toner particle 12 | resin particle dispersion 1 | 31 | 29 | 2 | 0.10 | 300 |
| Example 13 | toner particle 13 | resin particle dispersion 1 | 57 | 54 | 3 | 0.10 | 300 |
| Example 14 | toner particle 14 | resin particle dispersion 1 | 51 | 49 | 2 | 0.10 | 60 |
| Example 15 | toner particle 15 | resin particle dispersion 1 | 52 | 40 | 12 | 0.35 | 300 |
| Example 16 | toner particle 16 | resin particle dispersion 8 | 65 | 45 | 20 | 0.10 | 300 |
| Example 17 | toner particle 17 | resin particle dispersion 1 | 65 | 62 | 3 | 0.10 | 300 |
| Example 18 | toner particle 18 | resin particle dispersion 1 | 51 | 49 | 2 | 0.10 | 300 |
| Comparative Example 1 | toner particle 19 | resin particle dispersion 1 | 52 | 50 | 2 | 0.10 | 50 |
| Comparative Example 2 | toner particle 20 | resin particle dispersion 1 | 50 | 40 | 10 | 0.40 | 300 |
| Comparative Example 3 | toner particle 21 | resin particle dispersion 8 | 65 | 40 | 25 | 0.10 | 300 |

TABLE 5-continued

| | | | conditions in the annealing treatment step | | | | |
|---|---|---|---|---|---|---|---|
| | | | highest temperature (° C.) | lowest temperature (° C.) | temperature variation range (° C.) | maximum temperature variation rate (° C./minute) | treatment time (minutes) |
| Comparative Example 4 | toner particle 22 | resin particle dispersion 1 | 68 | 66 | 2 | 0.10 | 300 |
| Comparative Example 5 | toner particle 23 | resin particle dispersion 1 | 27 | 25 | 2 | 0.10 | 300 |
| Comparative Example 6 | toner particle 24 | resin particle dispersion 12 | 51 | 49 | 2 | 0.10 | 300 |

TABLE 6

| | | | endothermic peak | |
|---|---|---|---|---|
| | | toner Tg (° C.) | Tmp (° C.) | endothermic quantity ΔH (J/g) |
| Example 1 | toner particle 1 | 53 | 75 | 14.2 |
| Example 2 | toner particle 2 | 49 | 77 | 20.3 |
| Example 3 | toner particle 3 | 53 | 71 | 11.5 |
| Example 4 | toner particle 4 | 48 | 77 | 17.9 |
| Example 5 | toner particle 5 | 50 | 69 | 7.9 |
| Example 6 | toner particle 6 | 53 | 79 | 17.2 |
| Example 7 | toner particle 7 | 53 | 79 | 17.4 |
| Example 8 | toner particle 8 | 55 | 85 | 21.1 |
| Example 9 | toner particle 9 | 48 | 65 | 9.8 |
| Example 10 | toner particle 10 | 53 | 86 | 24.7 |
| Example 11 | toner particle 11 | 48 | 62 | 9.1 |
| Example 12 | toner particle 12 | 49 | 75 | 11.9 |
| Example 13 | toner particle 13 | 53 | 75 | 15.7 |
| Example 14 | toner particle 14 | 48 | 66, 75 | 10.0 |
| Example 15 | toner particle 15 | 51 | 72 | 12.1 |
| Example 16 | toner particle 16 | 52 | 81 | 20.2 |
| Example 17 | toner particle 17 | 52 | 75 | 16.8 |
| Example 18 | toner particle 18 | 54 | 75 | 15.6 |
| Comparative Example 1 | toner particle 19 | 46 | 66, 75 | 6.9 |
| Comparative Example 2 | toner particle 20 | 48 | 70 | 10.1 |
| Comparative Example 3 | toner particle 21 | 50 | 80 | 19.0 |
| Comparative Example 4 | toner particle 22 | 43 | 68, 75 | 5.6 |
| Comparative Example 5 | toner particle 23 | 45 | 66, 75 | 6.5 |
| Comparative Example 6 | toner particle 24 | 40 | 84 | 22.0 |

With regard to the melting point Tmp (° C.) for the endothermic peak given in Table 6, a plurality of peak temperatures are given when a plurality were observed. The total value encompassing the plurality of endothermic peaks is given for the endothermic quantity ΔH in such a case. In the case of overlap with the endothermic peak originating from the release agent, the value given by subtracting the endothermic quantity attributable to the release agent is used. The endothermic quantity attributable to the release agent was calculated from the endothermic quantity for the release agent itself and the amount of release agent introduced into the toner.

<Production of the Individual Toners>

For each of the toner particles obtained in Examples 1 to 18 and Comparative Examples 1 to 6, a toner was obtained by adding 1.0 parts of silica fine particles having a number-average particle diameter for the primary particles of 40 nm, to 100.0 parts of the toner particles and mixing using an FM Mixer (Nippon Coke & Engineering Co., Ltd.).

The properties of each of the resulting toners were evaluated using the following methods.

[The Heat Resistance]

5 g of each individual toner was placed in a 50-cc plastic cup and was then held for 3 days at a temperature of 50° C. and a humidity of 10% RH, after which the evaluation was performed by checking for the presence/absence of agglomerates.

(Evaluation Criteria)

A: Agglomerates are not produced (superior heat resistance).

B: Minor agglomerates are produced and are easily eliminated with light shaking (excellent heat resistance).

C: Minor agglomerates are produced and are eliminated by light finger pressure (heat resistance is unproblematic).

D: Agglomerates are produced and are not broken up even with light finger pressure (moderately poor heat resistance, problematic from a use standpoint).

E: Complete agglomeration (poor heat resistance, problematic from a use standpoint).

[Developing Performance]

This evaluation was carried out using a commercial color laser printer (HP Color LaserJet 3525dn, from Hewlett-Packard), which had been modified to operate with just a single color process cartridge installed. The toner was removed from the cyan cartridge that was installed in this color laser printer and its interior was cleaned using an air blower and the toner (300 g) to be evaluated was then filled thereinto as a replacement. A solid image was output at normal temperature and normal humidity (23° C., 60% RH) using Office Planner (64 g/m$^2$, from Canon, Inc.) as the image-receiving paper, and, using a MacBeth densitometer (a reflection densitometer from the MacBeth Corporation, an SPI filter was used), the relative reflection density was measured on this solid image versus the printed-out image of a white background area that had an original density of 0.00. The evaluation criteria are given below.

(Evaluation Criteria)

A: The reflection density is at least 1.40 (superior developing performance).

B: The reflection density is at least 1.30 but less than 1.40 (excellent developing performance).

C: The reflection density is at least 1.25 but less than 1.30 (developing performance is unproblematic).

D: The reflection density is at least 1.20 but less than 1.25 (moderately poor developing performance, problematic from a use standpoint).

E: The reflection density is less than 1.20 (poor developing performance, problematic from a use standpoint).

The timewise change behavior in the developing performance was evaluated by measuring the reflection density as described above using the individual toner that had been held for 30 days in an environment of a temperature of 45° C. and a humidity of 10% RH. The evaluation criteria are given below.

(Evaluation Criteria)

A: The reflection density is at least 1.40 (superior timewise change behavior).

B: The reflection density is at least 1.30 but less than 1.40 (excellent timewise change behavior).

C: The reflection density is at least 1.25 but less than 1.30 (timewise change behavior is unproblematic).

D: The reflection density is at least 1.20 but less than 1.25 (moderately poor timewise change behavior, problematic from a use standpoint).

E: The reflection density is less than 1.20 (poor timewise change behavior, problematic from a use standpoint).

[The Fixing Performance]

A color laser printer (HP Color LaserJet 3525dn, Hewlett-Packard) with an externalized fixing unit was prepared; the toner was removed from the cyan cartridge; and the toner to be evaluated was filled as a replacement. Then, using the filled toner, a 2.0 cm long by 15.0 cm wide unfixed toner image (0.6 mg/cm$^2$) was formed on the image-receiving paper (Office Planner from Canon, Inc., 64 g/m$^2$) at a position 1.0 cm from the top edge considered in the paper transit direction. The externalized fixing unit was modified so the fixation temperature and process speed could be adjusted and was used to conduct a fixing test on the unfixed image.

First, operating in a normal temperature and normal humidity environment (23° C., 60% RH) at a process speed of 200 mm/s and with the lineal fixing pressure set to 20.0 kgf and the initial temperature set to 100° C., the unfixed image was fixed at each temperature level while raising the set temperature sequentially in 5° C. increments.

The evaluation criteria for the low-temperature fixability are given below. The low-temperature-side fixing starting point is the lower limit temperature at which the phenomenon of cold offset (phenomenon in which a portion of the toner ends up adhering to the fixing unit) is not observed.

A: The low-temperature-side fixing starting point is equal to or less than 110° C. (superior low-temperature fixability).

B: The low-temperature-side fixing starting point is 115° C. or 120° C. (excellent low-temperature fixability).

C: The low-temperature-side fixing starting point is 125° C. or 130° C. (unproblematic low-temperature fixability).

D: The low-temperature-side fixing starting point is 135° C. or 140° C. (somewhat poor low-temperature fixability, problematic from a use standpoint).

E: The low-temperature-side fixing starting point is 145° C. or more (poor low-temperature fixability, problematic from a use standpoint).

The results are given in Table 7.

TABLE 7

| | | low-temperature fixability | | | | | timewise change | |
|---|---|---|---|---|---|---|---|---|
| | | | low-temperature-side fixing starting point | heat | developing performance reflection density | | behavior reflection density after timewise change | |
| | | rank | (° C.) | resistance | rank | density | rank | density |
| Example 1 | toner particle 1 | A | 110 | A | A | 1.46 | A | 1.45 |
| Example 2 | toner particle 2 | A | 105 | B | B | 1.37 | C | 1.29 |
| Example 3 | toner particle 3 | B | 115 | A | A | 1.45 | A | 1.45 |
| Example 4 | toner particle 4 | A | 105 | C | B | 1.32 | C | 1.26 |
| Example 5 | toner particle 5 | C | 130 | A | A | 1.44 | A | 1.45 |
| Example 6 | toner particle 6 | B | 120 | A | A | 1.45 | A | 1.43 |
| Example 7 | toner particle 7 | C | 125 | A | B | 1.33 | B | 1.33 |
| Example 8 | toner particle 8 | B | 115 | A | A | 1.47 | A | 1.46 |
| Example 9 | toner particle 9 | A | 110 | B | B | 1.36 | B | 1.36 |
| Example 10 | toner particle 10 | C | 125 | A | A | 1.43 | A | 1.43 |
| Example 11 | toner particle 11 | A | 105 | C | B | 1.32 | C | 1.28 |
| Example 12 | toner particle 12 | B | 115 | B | B | 1.35 | C | 1.26 |
| Example 13 | toner particle 13 | A | 110 | C | B | 1.32 | C | 1.26 |
| Example 14 | toner particle 14 | A | 110 | C | B | 1.39 | C | 1.27 |
| Example 15 | toner particle 15 | A | 110 | B | A | 1.41 | B | 1.33 |
| Example 16 | toner particle 16 | B | 115 | B | A | 1.46 | B | 1.38 |
| Example 17 | toner particle 17 | A | 110 | C | B | 1.34 | C | 1.25 |
| Example 18 | toner particle 18 | A | 110 | A | A | 1.46 | A | 1.45 |
| Comparative Example 1 | toner particle 19 | A | 110 | D | C | 1.27 | D | 1.24 |
| Comparative Example 2 | toner particle 20 | A | 110 | C | D | 1.21 | D | 1.20 |
| Comparative Example 3 | toner particle 21 | B | 115 | B | C | 1.25 | D | 1.21 |
| Comparative Example 4 | toner particle 22 | A | 110 | E | D | 1.22 | E | 1.15 |
| Comparative Example 5 | toner particle 23 | A | 110 | D | B | 1.30 | D | 1.24 |
| Comparative Example 6 | toner particle 24 | B | 120 | E | D | 1.24 | E | 1.16 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-049373, filed Mar. 12, 2014, which is hereby incorporated by reference herein in its entirety.

What is claimed is:

1. A method of producing a toner particle, comprising the steps of:

preparing a resin solution by dissolving, in an organic solvent, a binder resin having a polyester resin as its major component, and a block polymer having a crystalline polyester segment and a vinyl polymer segment;

preparing a resin solution dispersion by dispersing the resin solution in an aqueous medium; and removing the organic solvent present in the resin solution dispersion to produce a resin particle dispersion in which a pre-annealing-treatment resin particle is dispersed in the aqueous medium, the method further comprising a step of holding the resin particle dispersion for at least 60 minutes under temperature conditions that satisfy the following (i), (ii), and (iii):

(i) from TgA-15 (° C.) to TmA (° C.);

(ii) a temperature variation range of not more than 20° C.; and (iii) a temperature variation rate of not more than 0.35° C./minute, where TgA (° C.) indicates a glass transition point of the pre-annealing-treatment resin particle and TmA (° C.) indicates an onset temperature of an endothermic peak originating from the block polymer present in the pre-annealing-treatment resin particle.

2. The method of producing a toner particle according to claim 1, wherein the temperature range in the annealing step is from TgA-15 (° C.) to TcA (° C.), which is a temperature at the finish of the heat generation that accompanies crystallization of the block polymer present in the pre-annealing-treatment resin particle.

3. The method of producing a toner particle according to claim 1, wherein the polyester segment of the block polymer has a unit expressed by formula (1) below and a unit expressed by formula (2) below and satisfies the relationship $14 \leq m+n \leq 22$:

[C1]

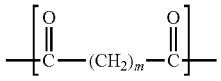

(1)

(m in formula (1) represents an integer from 6 to 14)

[C2]

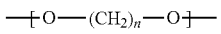

(2)

(n in formula (2) represents an integer from 6 to 16).

4. The method of producing a toner particle according to claim 1, wherein a glass transition point TgB (° C.) of the vinyl polymer segment of the block polymer is equal to or greater than TmA (° C.).

5. The method of producing a toner particle according to claim 1, wherein the mass ratio (C/A) between the polyester segment (C) and the vinyl polymer segment (A) in the block polymer is 40/60 to 70/30.

6. The method of producing a toner particle according to claim 1, wherein the vinyl polymer segment comprises a segment originating from a styrene.

* * * * *